US007841391B2

(12) United States Patent
Hao et al.

(10) Patent No.: US 7,841,391 B2
(45) Date of Patent: Nov. 30, 2010

(54) FLOODED TYPE EVAPORATING HEAT-EXCHANGE COPPER TUBE FOR AN ELECTRICAL REFRIGERATION UNIT

(75) Inventors: Yunyu Hao, Xinxiang (CN); Qiang Jiang, Anyang (CN); Chuanfu Yu, Xinxiang (CN); Shuang Zhao, Xinxiang (CN)

(73) Assignee: Golden Dragon Precise Copper Tube Group, Inc. (CN)

( * ) Notice: Subject to any disclaimer, the term of this patent is extended or adjusted under 35 U.S.C. 154(b) by 964 days.

(21) Appl. No.: 11/609,624

(22) Filed: Dec. 12, 2006

(65) Prior Publication Data

US 2007/0151715 A1 Jul. 5, 2007

(30) Foreign Application Priority Data

Dec. 13, 2005 (CN) ..... 2005 1 01346309

(51) Int. Cl.
*F28F 13/18* (2006.01)

(52) U.S. Cl. ..... 165/133; 165/181; 138/38; 29/890.053

(58) Field of Classification Search ..... 165/133, 165/179, 181; 29/890.046, 890.045, 890.048, 29/890.049, 890.053; 138/38
See application file for complete search history.

(56) References Cited

U.S. PATENT DOCUMENTS 3,768,290 A * 10/1973 Zatell ..... 72/68
4,313,248 A * 2/1982 Fujikake ..... 29/890.051
4,549,606 A * 10/1985 Sato et al. ..... 165/179
4,660,630 A * 4/1987 Cunningham et al. ..... 165/133
5,186,252 A * 2/1993 Nishizawa et al. ..... 165/181

(Continued)

FOREIGN PATENT DOCUMENTS

CN 2226744 Y 5/1996

(Continued)

OTHER PUBLICATIONS

"Chinese Patent Application Serial No. 200510134630.9, Office Action dated Mar. 21, 2008", 4 pgs.

*Primary Examiner*—Terrell L McKinnon
(74) *Attorney, Agent, or Firm*—Schwegman, Lundberg & Woessner, P.A.

(57) ABSTRACT

The present invention discloses a flooded type evaporating heat-exchange copper tube for an electrical refrigeration unit. The evaporating heat-exchange tube comprises a smooth surface portion, a finned portion provided with plurality of fins and a transitional portion connecting the smooth surface portion to the finned portion, with primary evaporating chambers defined between the fins. Fifth fins extending upwardly are provided on a bottom wall of the primary evaporating chamber, which divide the primary evaporating chamber into at least two minor cavities, and an evaporating opening is defined between adjacent fins of the primary evaporating chamber. Due to plurality of minor cavities arranged in the evaporating heat-exchange tube, refrigerant film is easy to form on bottom walls of the minor cavities, and nucleus boiling is easily to be developed. Thereafter, the refrigerant gets boiled and evaporated to form bubbles to escape via evaporating openings. Surrounding refrigerant refills the empty minor cavities via the evaporating opening. This process of boiling, evaporation and refilling continues to go on. Thus, the number of vaporization nucleus is dramatically increased, and the refrigerant is much easier to form nucleus and get vaporized, thus improving the heat transfer property of the evaporating heat-exchange tube.

10 Claims, 3 Drawing Sheets

U.S. PATENT DOCUMENTS 5,203,404 A * 4/1993 Chiang et al. ..... 165/133
5,333,682 A * 8/1994 Liu et al. ..... 165/133
5,692,560 A * 12/1997 Messant et al. ..... 165/151
5,697,430 A * 12/1997 Thors et al. ..... 165/133
5,775,411 A * 7/1998 Schuez et al. ..... 165/133
6,173,762 B1 * 1/2001 Ishida et al. ..... 165/133
6,176,302 B1 * 1/2001 Takahashi et al. ..... 165/133

FOREIGN PATENT DOCUMENTS

CN 2572324 Y 9/2003
CN 2583935 Y 10/2003

* cited by examiner

FLOODED TYPE EVAPORATING HEAT-EXCHANGE COPPER TUBE FOR AN ELECTRICAL REFRIGERATION UNIT

RELATED APPLICATION

This application claims priority under 35 U.S.C. 119 to Chinese Patent Application Serial No. 200510134630.9, filed Dec. 13, 2005, which application is incorporated herein by reference and made a part hereof.

TECHNICAL FIELD

The present invention relates to an evaporating heat-exchange tube, especially to a flooded type evaporating heat-exchange copper tube for an electrical refrigeration unit.

BACKGROUND

In recent years, the development of the manufacturing technology for a refrigerator or an air conditioner has been advanced due to a rapid development in the refrigeration technique and air-conditioning technique. Most effort is concentrated on providing a refrigerator or air conditioner with higher efficiency, less volume and lower weight, as well as an improved refrigerant. Meanwhile, the design and technical application for an evaporating heat-exchange tube used in the refrigerator or air conditioner has also been continuously improved. Currently, there are several ways to improve an evaporating heat-exchange tube. One way to improve an evaporating heat-exchange tube is to increase the heat transfer area thereof. 1) To increase the area is to add heat-exchange fins or form heat-exchange fins directly on the outer surface of the evaporating heat-exchange tube. However, adding fins on the outer surface may lead to such a disadvantage that thermal resistance will be developed between the fins and the tube, while heat-exchange fins forming directly on the outer surface are often limited by the machining process and the size of the tube, such that a requirement to transfer heat rapidly may not be well met. 2) To provide a space at the interface of the tube and the refrigerant to promote the formation of a bubble nucleus, such that bubbles are easily formed in said space. Bubbles absorb heat near the tube surface and grow accordingly. Due to the surface tension, these bubbles may leave the tube surface only when their sizes become large enough to overcome the surface tension. A prior art promotion space at the tube surface is relatively large. Therefore, the bubble size needed to overcome the surface tension is also quite large, and the rate of the heat transfer is slowed sown. Meanwhile, this also slows down the formation rate of new bubbles. 3) In prior art evaporating heat-exchange tube, the length for a transitional portion between a smooth surface and a finned surface is about 60 mm. The longer this transitional length is, the more will be incomplete fins, and the more will the refrigeration property be adversely affected.

SUMMARY OF THE INVENTION

An object of the present invention is to provide an evaporating heat-exchange tube with high efficiency.

A technical solution is developed to achieve said object. A flooded type evaporating heat-exchange copper tube for an electrical refrigeration unit according to the present invention comprises a smooth surface portion, a finned portion provided with plurality of fins and a transitional portion connecting the smooth surface portion to the finned portion, with primary evaporating chambers defined between the fins, wherein fifth fins extending upwardly are provided on a bottom wall of the primary evaporating chamber, which divide the primary evaporating chamber into at least two minor cavities, and an evaporating opening is defined between adjacent fins of the primary evaporating chamber.

Preferably, secondary grooves perpendicular to the axis of the evaporating heat-exchange tube are also provided on the finned portion.

Preferably, the depth of the secondary groove is between 0.15 and 0.35 mm, the width of the secondary groove is between 0.15 and 0.25 mm, and the number of the secondary groove provided on a complete round of the tube is between 60 and 125.

Preferably, third grooves forming an angle between 120° and 160° with respect to the axis of the evaporating heat-exchange tube are also provided on the finned portion.

Preferably, the depth of the third groove is between 0.15 and 0.35 mm, the width of the third groove is between 0.15 and 0.25 mm, and the number of the third groove provided on a complete round of the tube is between 60 and 125.

Preferably, fourth grooves forming an angle between 20° and 60° with respect to the axis of the evaporating heat-exchange tube are also provided on the finned portion.

Preferably, the depth of the fourth groove is between 0.15 and 0.35 mm, the width of the fourth groove is between 0.15 and 0.25 mm, and the number of the fourth groove provided on a complete round is between 60 and 125.

Preferably, an inner surface of the evaporating heat-exchange tube is further provided with inner teeth.

Preferably, the number of the inner teeth per inch is between 30 and 60, the height of the inner teeth is between 0.2 and 0.4 mm, the pitch angle for the inner teeth is between 30° and 60°, and the addendum angle for the inner teeth is between 30° and 60°.

Preferably, the fins are provided with a T-shaped configuration, and the height of the fifth fin is between 0.1 and 0.25 mm, the width of the fifth fin is between 0.05 and 0.15 mm, and the number of the fifth fin within each primary groove is between 1 and 4.

The present is advantageous over the prior art as following: (1) Plurality of fifth fins arranged in the primary evaporating chamber divide the evaporating chamber into several minor cavities. Nucleus boiling is easily developed in a refrigerant film on the bottom wall of the minor cavity. Thereafter, the refrigerant film boils and evaporates to form bubbles to escape via evaporating openings. Afterwards, surrounding refrigerant refills the empty minor cavities via the evaporating opening. This process of boiling, evaporation and refilling continues to go on. Thus, due to the configuration of a primary evaporating chamber with plurality of minor cavities, the number of vaporization nucleus is dramatically increased, and the refrigerant is much easier to form nucleus and get vaporized, thus speeding up the vaporization process. (2) Secondary grooves, third grooves, and fourth grooves according to the invention may further disturb the flow as well as provide more channels, through which bubbles may escape and refrigerant may fill in, to further improve the refrigeration property. (3) Inner teeth, with an appropriate number and with a substantially triangular configuration, are provided on the evaporating heat-exchange tube according to the present invention. Therefore, the heat transfer area within the tube is increased and a secondary turbulent flow for the heat-exchange water within the tube is developed, such that the heat transfer efficiency in the tube is dramatically increase. (4) The transitional length L between the smooth surface portion and the finned portion according to the invention is relatively small (5 to 25 mm). Therefore, the number of incomplete fins is reduced, which corresponds to an increase in the heat transfer area. Therefore, the utilization ratio is increased, thus improving the heat transfer efficiency. (5) Inner teeth on the inner surface of the evaporating heat-exchange tube as well as evaporating chamber on the outer surface thereof is employed to improve the heat transfer property within as well as outside of the tube. Meanwhile, the wall thickness and outer diameter of the tube are so well designed that the overall heat transfer coefficient of the copper tube is greatly improved, thus further improving the overall heat transfer property of the evaporator.

| Numerals | |
|---|---|
| 100: | evaporating heat-exchanging tube |
| 1: | finned portion |
| 11: | primary fin |
| 111: | primary evaporating chamber |
| Df: | outer diameter of the finned end |
| Tf: | wall thickness of the finned end |
| Ew: | width of the primary groove |
| Fh1: | height of the fin |
| FPI: | number of fins per inch |
| 110: | evaporating opening |
| Eg: | width of the evaporating groove |
| 112: | secondary groove |
| H2: | depth of the secondary groove |
| L2: | width of the secondary groove |
| 113: | third groove |
| H3: | depth of the third groove |
| L3: | width of the third groove |
| 114: | fourth groove |
| H4: | depth of the fourth groove |
| L4: | width of the fourth groove |
| 12: | fifth fin |
| H5: | height of the fifth fin |
| L5: | width of the fifth fin |
| 121: | fifth groove |
| 3: | transitional portion |
| 5: | smooth surface portion |
| D: | outer diameter for the smooth surface portion |
| T: | wall thickness for the smooth surface portion |
| 15: | inner tooth |
| Rh: | height of the inner tooth |
| β1: | pitch angle for the inner tooth |
| θ1: | addendum angle for the inner tooth |

EMBODIMENTS

A preferred embodiment of the present invention will be described in more details with reference to accompany drawings.

Figure 1:
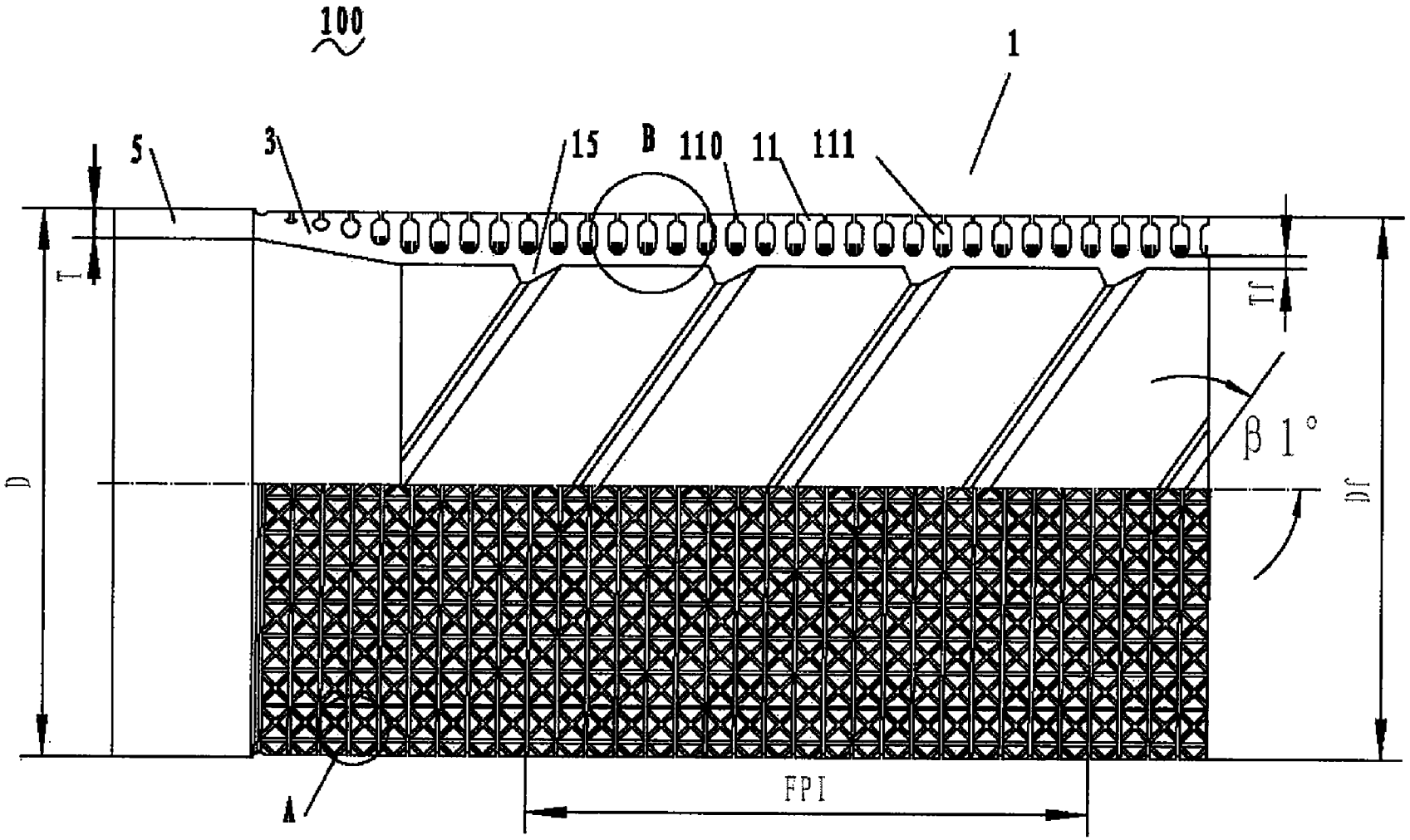
FIG. 1 is a semi-sectional view of the present invention.

Referring to FIG. 1, an evaporating heat-exchange tube 100 according to the present invention comprises a finned portion 1, smooth surface portions 5 arranged at both ends of the evaporating heat-exchange tube 100 (only one shown in FIG. 1), a transitional portion 3 arranged between the smooth surface portion 5 and the finned portion 1, and inner teeth 15 arranged inside the evaporating heat-exchange tube 100. The outer diameter D for the smooth surface portion 5 is between 12 and 26 mm, while the wall thickness T thereof is between 0.5 and 0.9 mm. The evaporating heat-exchange tube 100 according to the present invention is preferably made of copper material. After studying the heat-transfer mechanism, molding device, and molding process of a flooded type evaporating heat-exchange tube, the applicant chooses a range between 12 and 26 mm for the diameter D of the flooded type evaporating heat-exchange tube 100. The evaporating heat-exchange tube 100 is used in evaporating heat-exchange tubes of a flooded type evaporator, with refrigerant flowing outside of the tube and heat-exchange water flowing inside of the tube. The refrigerant flowing outside of the tube absorbs heat in the heat-exchange water through the tube and evaporates, and the heat-exchange water is cooled down to realize refrigeration.

Figure 2:
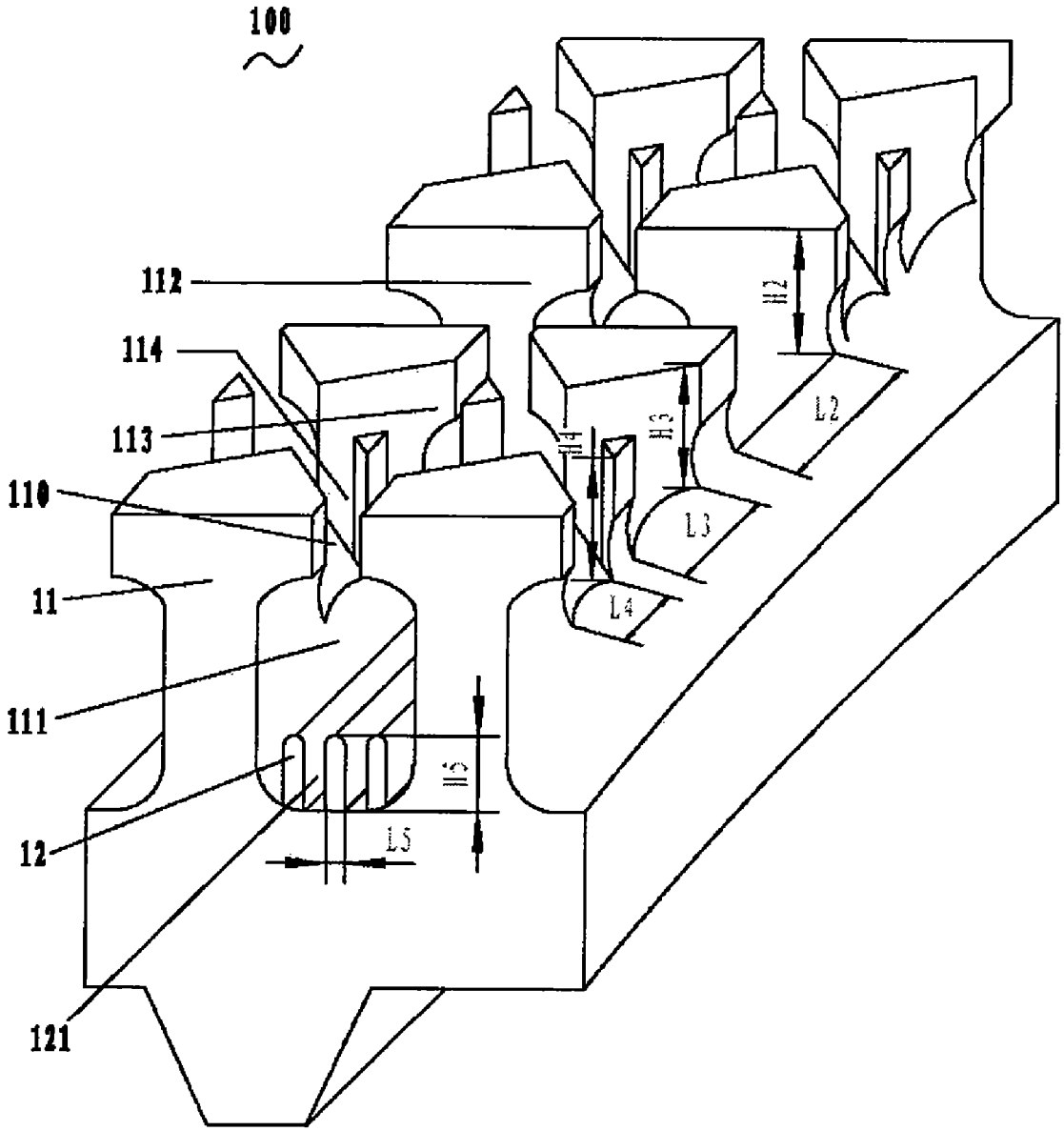
FIG. 2 illustrates a partial perspective view of the present invention.
Figure 3:
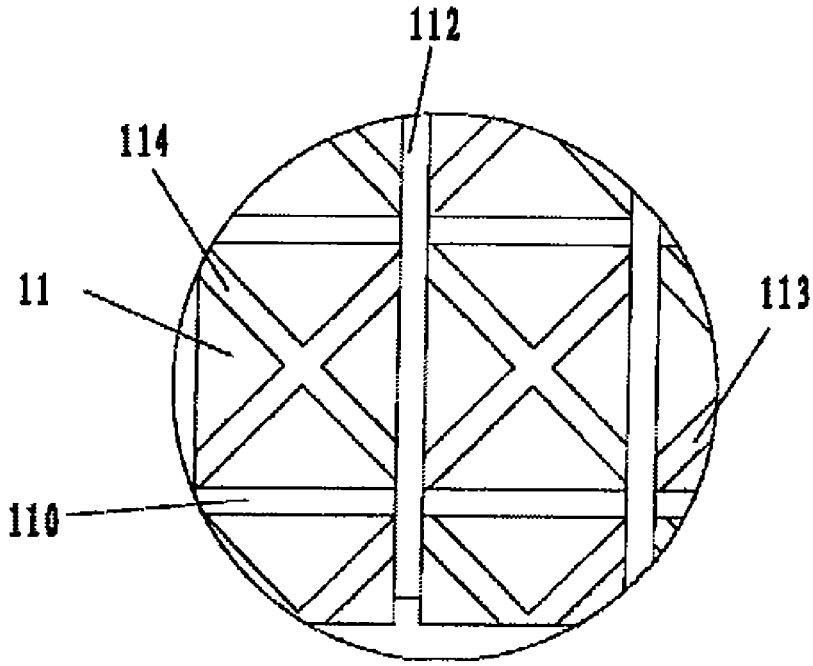
FIG. 3 is an enlarged view of the portion A in FIG. 1.
Figure 4:
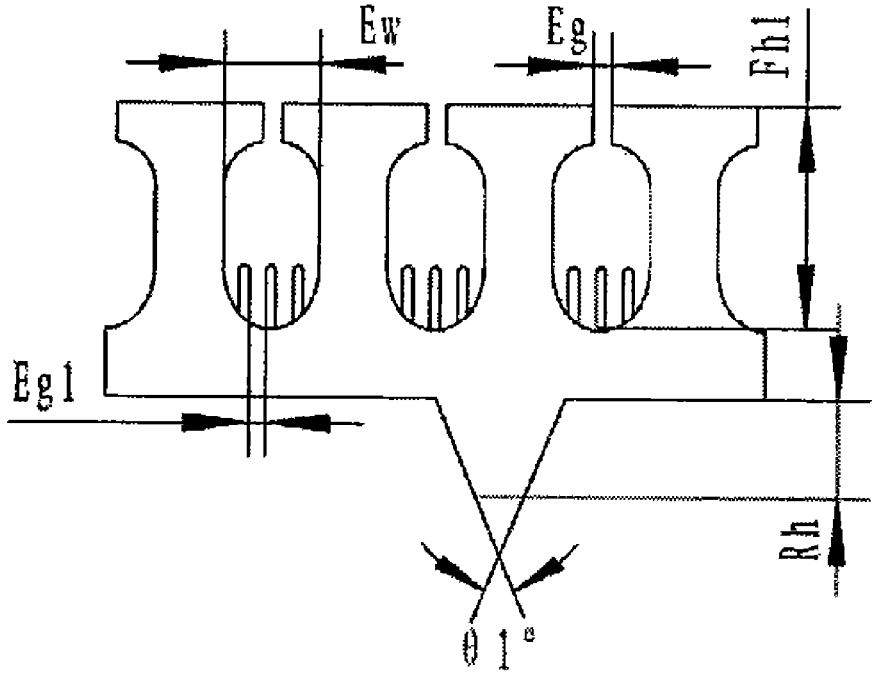
FIG. 4 is an enlarged view of the portion B in FIG. 1.

Referring to FIGS. 2 to 4, the outer diameter Df of the finned end for the finned portion 1 is between 12 and 26 mm, while the wall thickness Tf of the finned end is between 0.5 and 1.0 mm. A fin 11 arranged on the outer surface of the finned portion 1 is substantially T-shaped, while the height Fh1 for the fin 11 is between 0.5 and 1.0 mm, and a number FPI of fins per inch is between 30 and 50. An evaporating opening 110 is provided between the upper portions of the two adjacent fins 11, and the width Eg of an evaporating groove for the evaporating opening 110 is between 0.1 and 0.2 mm. The fins 11 are primary fins, with a width Ew of the primary groove between 0.35 and 0.65 mm.

Referring to FIGS. 1 to 3, fins 11 are also provided with secondary grooves 112 perpendicular to the axis of the evaporating heat-exchange tube 100, third grooves 113 having an angle between 120° and 160°, preferably at 135°, to the axis of the evaporating heat-exchange tube 100, and fourth grooves 114 having an angle between 20° and 40°, preferably 45°, to the axis of the evaporating heat-exchange tube 100. The depth H2 of the secondary groove 112 is between 0.15 and 0.35 mm, while the width L2 thereof is between 0.15 and 0.25 mm. The number of secondary grooves provided on a complete round of the tube is in range of 60 to 125. The depth H3 of the third groove 113 is between 0.15 and 0.35 mm, while the width L3 thereof is between 0.15 and 0.25 mm. The number of the third grooves provided on a complete round of the tube is in the range of 60 to 125. The depth H4 of the fourth groove 114 is between 0.15 and 0.35 mm, while the width L4 thereof is between 0.15 and 0.25 mm. The number of the fourth grooves provided on a complete round of tube in range of 60 to 125. These secondary grooves 112, third grooves 113, and fourth grooves 114 communicate with each other, such that fluid of the refrigerant may fill and flow within these secondary grooves 112, third grooves 113, and fourth grooves 114. Therefore, the contact area for heat transfer between the refrigerant and the outer surface of the evaporating heat-exchange tube 100 increases dramatically.

A primary evaporating chamber 111 with a substantially oval cross-section is defined between two adjacent fins 11. The largest width for the primary evaporating chamber 111 is the width of the primary groove Ew. Primary evaporating chambers 111 communicate with above secondary grooves 112, third grooves 113, and fourth grooves 114, such that refrigerant may fill the primary evaporating chambers 111 simultaneously, further increasing the contact area for heat transfer between the refrigerant and the evaporating heat-exchange tube 100. Some fifth fins 12 extending upwardly are also provided on the bottom wall of primary evaporating chambers 111. Preferably, 1 to 4, preferably 3, fifth fins 12 are provided for each primary evaporating chamber 111. The height H5 of the fifth fin 12 is between 0.10 and 0.25 mm, while the width L5 of the fifth fin 12 is between 0.05 and 0.15 mm.

Bubble nucleus is easy to form within a primary evaporating chamber 111, initially on the bottom wall of the primary evaporating chamber 111. The bubble nucleus absorbs heat from the tube 100 and grows gradually. Due to fifth fins 12 arranged on the bottom wall of primary evaporating chambers 111 and dividing each primary evaporating chamber 111 into several minor cavities 121, plurality of bubbles may be formed within each evaporating chamber 111, dramatically increasing the number of vaporization nucleus needed for bubble nucleus boiling. Therefore, refrigerant is much easier to be nucleus vaporized. Plurality of bubbles formed in a primary evaporating chamber 111 escape this primary evaporating chamber 111 via the evaporating opening 110 to release heat within the evaporating heat-exchange tube 100. Afterwards, refrigerant refills the evaporating chamber 111 and minor cavities 121 in it via the evaporating opening 110. This process continues to go on. Therefore, heat transfer between the evaporating heat-exchange tube 100 and refrigerant is accelerated.

An evaporating heat-exchange tube according to the present invention is manufactured by using a core print as an internal mold, a die as an external mold and a gang tool as well as cold working process. Fins 11, grooves 112 to 114 as well as fifth fins 12 are formed on the outer surface of the tube. Meanwhile, an inner tooth 15 is also developed on the inner surface of the evaporating heat-exchange tube 100. The inner tooth 15 is preferably continuous and defines a substantially triangular section. The top portion and the root portion of the inner tooth 15 may be both rounded. The number of the inner tooth 15 per inch is between 30 and 60. The height Rh of the inner tooth 15 is between 0.2 and 0.4 mm. The pitch angle $\beta 1$ for the inner tooth 15 is between 30° and 60°, and the addendum angle $\theta 1$ for the inner tooth 15 is between 30° and 60°. The inner tooth 15 increases the heat transfer area within the tube, and results in a secondary turbulent flow of the cooling medium water within the tube 100. Therefore, the heat transfer property of the evaporating heat-exchange tube 100 is greatly improved.

As described above, T shaped fins 11 of the evaporating heat-exchange tube 100 according to the present invention define primary evaporating chambers 111. Fifth fins 12 divide the primary evaporating chamber 111 into several minor cavities 121. Nucleus boiling is easily developed in a refrigerant film on the bottom wall of the minor cavity 121 within the primary evaporating chamber 111. Thereafter, the refrigerant film boils and evaporates to form bubbles. Vapor within these bubbles absorbs so much heat that size of these bubbles starts to increase. As long as these bubbles get large enough, they leave the bottom wall of the evaporating heat-exchange tube 100 and escape from the tube via evaporating openings 110. Afterwards, surrounding refrigerant refills the empty minor cavities 121 and evaporating chambers 111 via the evaporating opening 110. This process of nucleus boiling, evaporation and refilling continues to go on. Therefore, heat transfer between the evaporating heat-exchange tube 100 and refrigerant is accelerated. Thus, due to the configuration of a primary evaporating chamber 111 with plurality of minor cavities 121, the number of vaporization nucleus is dramatically increased, and the refrigerant is much easier to form nucleus and get vaporized, thus speeding up the vaporization process.

Secondary grooves 112, third grooves 113, and fourth grooves 114 according to the invention may further disturb the flow as well as provide more channels, through which bubbles may escape openings 110 and refrigerant may fill in, to further improve the refrigeration property. Therefore, it may be understood that these secondary grooves 112, third grooves 113, and fourth grooves 114 do not belong to necessary technical features of the present invention. They only serve to further improve the refrigeration property of the evaporating heat-exchange tube 100 according to the invention.

Fins 11 are not limited to a T-shaped configuration. They can also be configured as an inverted triangle, an inverted trapezoid, etc., as long as a primary evaporating chamber 111 may be easily define between to adjacent fins 11 to promote nucleation of bubbles. Besides, fifth fins 12 in FIG. 2 extend along the pitch direction of the fins 11. Of course, the fifth fins 12 may extend in directions other than said pitch direction, such as in a direction perpendicular to the pitch direction.

The preferred embodiment disclosed above is in all aspects merely illustrative. An ordinary person skilled in the art may understand that amendments and modifications can be made without departing from the scope of the invention. All these amendments and modifications shall fall within the scope of the present invention.

The invention claimed is:

1. A flooded type evaporating heat-exchange copper tube for an electrical refrigeration unit, comprising a smooth surface portion, a finned portion provided with plurality of fins and a transitional portion connecting the smooth surface portion with the finned portion, with a primary evaporating chambers defined between the fins, characterized in that: fifth fins extending upwardly are provided on bottom wall of the primary evaporating chamber, which divide the primary evaporating chamber into at least two minor cavities, and in that: an evaporating opening is defined between adjacent fins of the primary evaporating chamber, and characterized in that the fifth fins are parallel with each other in a circumferential direction of the evaporating heat-exchange copper tube.

2. The flooded type evaporating heat-exchange copper tube for an electrical refrigeration unit according to claim 1, characterized in that: secondary grooves perpendicular to the axis of the evaporating heat-exchange tube are also provided on the finned portion.

3. A flooded type evaporating heat-exchange copper tube for an electrical refrigeration unit, comprising a smooth surface portion, a finned portion provided with plurality of fins and a transitional portion connecting the smooth surface portion with the finned portion, with a primary evaporating chambers defined between the fins, characterized in that: fifth fins extending upwardly are provided on bottom wall of the primary evaporating chamber, which divide the primary evaporating chamber into at least two minor cavities, and in that: an evaporating opening is defined between adjacent fins of the primary evaporating chamber, and in that: secondary grooves perpendicular to the axis of the evaporating heat-exchange tube are also provided on the finned portion, and characterized in that: the depth of the secondary groove is between 0.15 and 0.35 mm, the width of the secondary groove is between 0.15 and 0.25 mm, and the number of the secondary groove provided on a complete round of the tube is between 60 and 125.

4. A flooded type evaporating heat-exchange copper tube for an electrical refrigeration unit, comprising a smooth surface portion, a finned portion provided with plurality of fins and a transitional portion connecting the smooth surface portion with the finned portion, with a primary evaporating chambers defined between the fins, characterized in that: fifth fins extending upwardly are provided on bottom wall of the primary evaporating chamber, which divide the primary evaporating chamber into at least two minor cavities, and characterized in that: an evaporating opening is defined between adjacent fins of the primary evaporating chamber, and characterized in that: third grooves having an angle between 120° and 160° with respect to the axis of the evaporating heat-exchange tube are also provided on the finned portion.

5. The flooded type evaporating heat-exchange copper tube for an electrical refrigeration unit according to claim 4, characterized in that: the depth of the third groove is between 0.15 and 0.35 mm, the width of the third groove is between 0.15 and 0.25 mm, and the number of the third groove provided on a complete round of the tube is between 60 and 125.

6. A flooded type evaporating heat-exchange copper tube for an electrical refrigeration unit, comprising a smooth surface portion, a finned portion provided with plurality of fins and a transitional portion connecting the smooth surface portion with the finned portion, with a primary evaporating chambers defined between the fins, characterized in that: fifth fins extending upwardly are provided on bottom wall of the primary evaporating chamber, which divide the primary evaporating chamber into at least two minor cavities, and characterized in that: an evaporating opening is defined between adjacent fins of the primary evaporating chamber, and characterized in that: fourth grooves having an angle between 20° and 60° with respect to the axis of the evaporating heat-exchange tube are also provided on the finned portion.

7. The flooded type evaporating heat-exchange copper tube for an electrical refrigeration unit according to claim 6, characterized in that: the depth of the fourth groove is between 0.15 and 0.35 mm, the width of the fourth groove is between 0.15 and 0.25 mm, and the number of the fourth groove provided on a complete round of the tube is between 60 and 125.

8. The flooded type evaporating heat-exchange copper tube for an electrical refrigeration unit according to claim 1, characterized in that: an inner surface of the evaporating heat-exchange tube is further provided with inner teeth.

9. A flooded type evaporating heat-exchange copper tube for an electrical refrigeration unit, comprising a smooth surface portion, a finned portion provided with plurality of fins and a transitional portion connecting the smooth surface portion with the finned portion, with a primary evaporating chambers defined between the fins, characterized in that: fifth fins extending upwardly are provided on bottom wall of the primary evaporating chamber, which divide the primary evaporating chamber into at least two minor cavities, and characterized in that: an evaporating opening is defined between adjacent fins of the primary evaporating chamber, characterized in that: an inner surface of the evaporating heat-exchange tube is further provided with inner teeth, and characterized in that: the number of the inner teeth per inch is between 30 and 60, the height of the inner teeth is between 0.2 and 0.4 mm, the pitch angle for the inner teeth is between 30° and 60° , and the addendum angle for the inner teeth is between 30° and 60°.

10. The flooded type evaporating heat-exchange copper tube for an electrical refrigeration unit according to any one of claims 1 to 9, characterized in that: the fins have T shape, and the height of the fifth fin is between 0.1 and 0.25 mm, the width of the fifth fin is between 0.05 and 0.15 mm, and the number of the fifth fins within each primary groove is between 1 and 4.

* * * * *